US008305135B2

(12) United States Patent
Kikuchi

(10) Patent No.: US 8,305,135 B2
(45) Date of Patent: Nov. 6, 2012

(54) SEMICONDUCTOR DEVICE

(75) Inventor: Kazutaka Kikuchi, Kanagawa (JP)

(73) Assignee: Renesas Electronics Corporation, Kawasaki, Kanagawa (JP)

( * ) Notice: Subject to any disclaimer, the term of this patent is extended or adjusted under 35 U.S.C. 154(b) by 150 days.

(21) Appl. No.: 12/926,130

(22) Filed: Oct. 27, 2010

(65) Prior Publication Data

US 2011/0121890 A1 May 26, 2011

(30) Foreign Application Priority Data

Nov. 20, 2009 (JP) ..... 2009-264910

(51) Int. Cl.
*G05F 1/10* (2006.01)

(52) U.S. Cl. ..... 327/543; 327/541; 323/312

(58) Field of Classification Search ..... 327/543, 327/541; 323/312
See application file for complete search history.

(56) References Cited

U.S. PATENT DOCUMENTS 6,057,727 A * 5/2000 Dautriche et al. ..... 327/543
7,319,314 B1 * 1/2008 Maheshwari et al. ..... 323/313
2007/0024351 A1 * 2/2007 Kang ..... 327/541
2007/0262812 A1 * 11/2007 Gyohten et al. ..... 327/540
2008/0001661 A1 * 1/2008 Tachibana et al. ..... 330/253
2009/0121912 A1 * 5/2009 Zanchi et al. ..... 341/172
2009/0224823 A1 * 9/2009 Gyohten et al. ..... 327/538

FOREIGN PATENT DOCUMENTS

JP 2698702 9/1997
JP 3431446 5/2003

* cited by examiner

*Primary Examiner* — Ryan Jager
(74) *Attorney, Agent, or Firm* — McGinn IP Law Group, PLLC

(57) ABSTRACT

This invention allows for stable operation of a circuit to which an output voltage is supplied. The invention resides in a semiconductor device comprising a VREF1 regulator to which a reference voltage Vref1 relative to a first potential is input; and an output circuit which generates an output voltage Vint that is proportional to a voltage on its input terminal relative to a second potential. The VREF1 regulator comprises a constant current source which generates a constant current having a current value that is proportional to the reference voltage Vref1; and a first resistor element which is supplied with the constant current, one end of which is coupled to the input terminal of the output circuit and the other end of which is coupled to the second potential.

2 Claims, 3 Drawing Sheets

SEMICONDUCTOR DEVICE

CROSS-REFERENCE TO RELATED APPLICATIONS

The disclosure of Japanese Patent Application No. 2009-264910 filed on Nov. 20, 2009 including the specification, drawings and abstract is incorporated herein by reference in its entirety.

BACKGROUND OF THE INVENTION

The present invention relates to a semiconductor device and, particularly, to a semiconductor device that generates a lower voltage potential.

For use in a semiconductor device, a circuit that generates a lower voltage potential which is used an internal power supply is widely known. For example, a regulator is described in Japanese Patent No. 2698702, wherein the regulator is able to positively prevent saturation of an output transistor and also prevents saturation of a transistor installed to prevent the saturation of the output transistor. Further, a semiconductor integrated circuit (IC) is described in Japanese Patent No. 3431446, wherein the IC is able to supply a stable internal lower voltage potential over a wide spectrum of voltages, independently of whether consumption current is large or small, when the IC is in either standby or active state, by selectively using one of two types of step-down circuits, as appropriate, depending on a voltage range.

FIG. 3 is a circuit diagram of a main section of a step-down circuit found in such patent documents as Japanese Patent No. 2698702 and Japanese Patent No. 3431446. In FIG. 3, an internal power supply generator 1 which is a step-down circuit is the circuit that uses a PMOS transistor as an element for outputting a lower voltage potential. This circuit comprises a PMOS transistor P1, an operational amplifier circuit OP1, and two resistor elements R1, R2.

Of the operational amplifier circuit OP1, a noninverting terminal (+) is coupled to a node VFB1, an inverting terminal (−) is coupled to a node VREF1, and an output terminal is coupled to a node VG1. Of the PMOS transistor P1, a source is coupled to a node VEXT which supplies an external power supply potential, a drain is coupled to a node VINT which generates a potential Vint which is an output voltage as an internal power supply for a load circuit, and a gate is coupled to the node VG1. A resistor element R1 is coupled between the node VINT and the node VFB1 and a resistor element R2 is coupled between the node VFB1 and a ground GND2. An intermediate potential produced by dividing the potential Vint by a resistance ratio between the resistor elements R1, R2 is supplied to the node VFB1. Further, an output terminal of a reference voltage generator 5 is coupled to the node VREF1 and a stable reference potential Vref1 is always supplied as long as an external power supply is on.

In the configuration as described above, the output node VG1 of the operational amplifier circuit OP1 stabilizes at a potential, as the potentials on the node VREF1 and the node VFB1 coupled to two input terminals of the operational amplifier circuit OP1 are equal. According to the potential on the output node VG1, a current that is supplied from the external power supply potential VEXT via the PMOS transistor P1 to the node VINT is determined. By this current, the potential Vint is determined. Here, if the load current at the node VINT increases and the potential Vint slightly decreases transiently, the potential on the node VFB1 also decreases slightly according to the resistance ratio between the resistor elements R1, R2. When the operational amplifier circuit OP1 detects a decrease in the potential on the node VFB1, it amplifies this difference and applies a feedback so that the potential on the node VG1 will decrease. As a result, the current supplied via the PMOS transistor P1 to the node VINT increases and the potential Vint recovers. By means of such a feedback path and by always monitoring the potential on the node VFB1, the node VINT is set at a predefined potential Vint.

SUMMARY OF THE INVENTION

The following analysis is provided by the present inventors.

In designing semiconductors for memories and the like which have a large capacity and carry a large current, such as DRAMs, power supply and GND wiring must be designed to be enhanced so that a power supply and a GND within a chip will be substantially unaffected by IR-Drop even when in operating state. In some cases, however, power supply and GND wiring cannot be enhanced sufficiently because of package and chip area restriction. In such cases, due to the fact that a GND is locally elevated (the potential of the GND rises) in a section where a large current is generated when operating with a high wiring resistance, a potential difference between a GND for a reference voltage generator and the GND in the operating section takes place. The internal power supply potential relatively decreases because of the elevated GND and this potential decrease may cause a malfunction such as access delay.

Referring to FIG. 3, for example, assume the occurrence of a potential difference Vgnd2 between the ground GND1 for the reference voltage generator 5 which generates Vref1 and the ground GND2 for the internal power supply generator 1. In this assumption, the potential Vref1 on the node VREF1 relative to GND1 is constant. The potential Vint on the node VINT relative to GND2 is expressed by Equation (1) below:

$$Vint=(Vref1-Vgnd2)*(r1/r2+1) \quad (1)$$

where r1 is a value of resistance of the resistor element R1 and r2 is a value of resistance of the resistor element R2.

In Equation 1, when the potential of GND2 becomes higher than the potential of GND1 (Vgnd2>0), the potential Vint decreases, which may cause a malfunction such as access delay in circuits coupled between VINT and GND2. On the other hand, when the potential of GND2 becomes lower than the potential of GND1 (Vgnd2<0), the potential Vint increases, which may result in a high possibility of causing a fault, if Vint becomes so high as to exceed a withstand voltage.

A semiconductor device pertaining to a first aspect of the present invention comprises a reference voltage regulator to which a reference voltage relative to a first potential is input; and an output circuit which generates an output voltage that is proportional to a voltage on its input terminal relative to a second potential. The reference voltage regulator comprises a constant current source which generates a constant current having a current value that is proportional to the reference voltage; and a first resistor element which is supplied with the constant current, one end of which is coupled to the input terminal of the output circuit and the other end of which is coupled to the second potential.

According to the present invention, an output voltage variation can be prevented, even if there occurs a potential difference between first and second potentials. Therefore, the invention allows for stable operation of a circuit to which the output voltage is supplied.

DETAILED DESCRIPTION OF THE PREFERRED EMBODIMENT

A semiconductor device pertaining to an embodiment of the present invention comprises a reference voltage regulator (which corresponds to 2 in FIG. 1) to which a reference voltage (Vref1 in FIG. 1) relative to a first potential is input; and an output circuit (which corresponds to 1 in FIG. 1) which generates an output voltage that is proportional to a voltage on its input terminal relative to a second potential. The reference voltage regulator comprises a constant current source (which corresponds to 4 in FIG. 1) which generates a constant current having a current value that is proportional to the reference voltage; and a first resistor element (which corresponds to R3 in FIG. 1) which is supplied with the constant current, one end of which is coupled to the input terminal of the output circuit and the other end of which is coupled to the second potential.

In the semiconductor device, the first and second potentials may be the respective potentials of two points having a potential difference therebetween in ground wiring.

Figure 3:
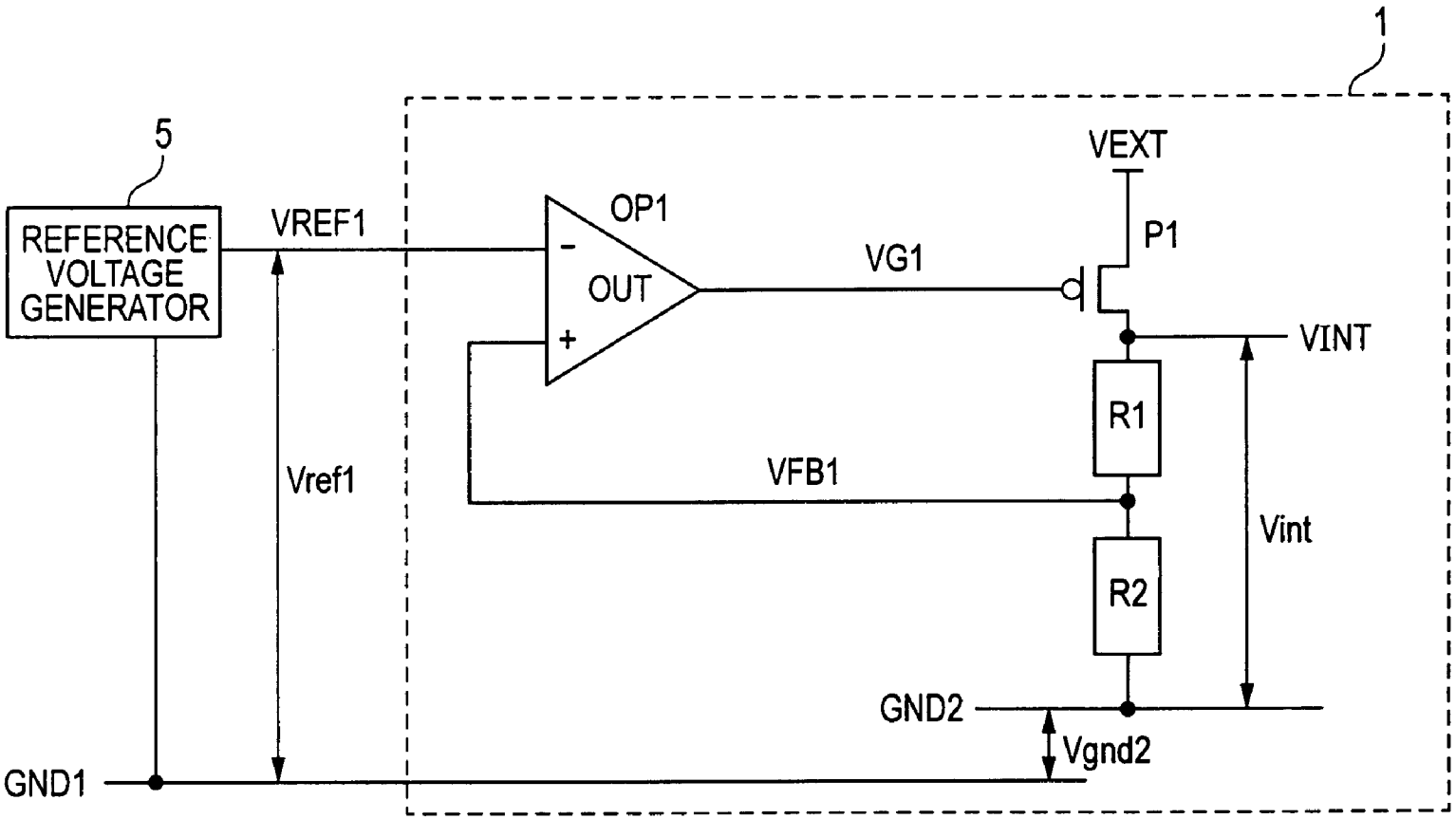
FIG. 3 is a circuit diagram of a main section of a conventional step-down circuit.

In the semiconductor device, the reference voltage regulator may further comprise a current regulator (which corresponds to 3 in FIG. 3) which generates an internal current that is proportional to the reference voltage and drives the constant current source to generate the constant current that is proportional to the internal current.

In the semiconductor device, the current regulator may comprise an operational amplifier (which corresponds to OP2 in FIG. 2) with an inverting input terminal to which the reference voltage is applied; a first MOS transistor (which corresponds to P2 in FIG. 2) having a source being coupled to a predefined power supply, a gate being coupled to an output of the operational amplifier, and a drain being coupled to a noninverting input terminal of the operational amplifier; and a second resistor element (which corresponds to R4 in FIG. 2), one end of which is coupled to the drain of the first MOS transistor and the other end of which is coupled to the first potential. The constant current source may comprise a second MOS transistor (which corresponds to P3 in FIG. 2) of the same conductivity type as the first MOS transistor, the second MOS transistor having a source being coupled to the predefined power supply, a gate being coupled to the output of the operational amplifier, and a drain through which the constant current is supplied to the first resistor element.

According to the semiconductor device as described above, the output voltage (which corresponds to Vint in FIG. 1) of the output circuit remains at a constant potential independently of a potential difference between the first and second potentials. That is, even if there occurs a potential difference between the first and second potentials, an internal current to which the output voltage is supplied operates stably with the power supply voltage of a constant potential.

In the following, the invention will be described in detail by way of an exemplary embodiment with reference to the drawings.

First Embodiment

Figure 1:
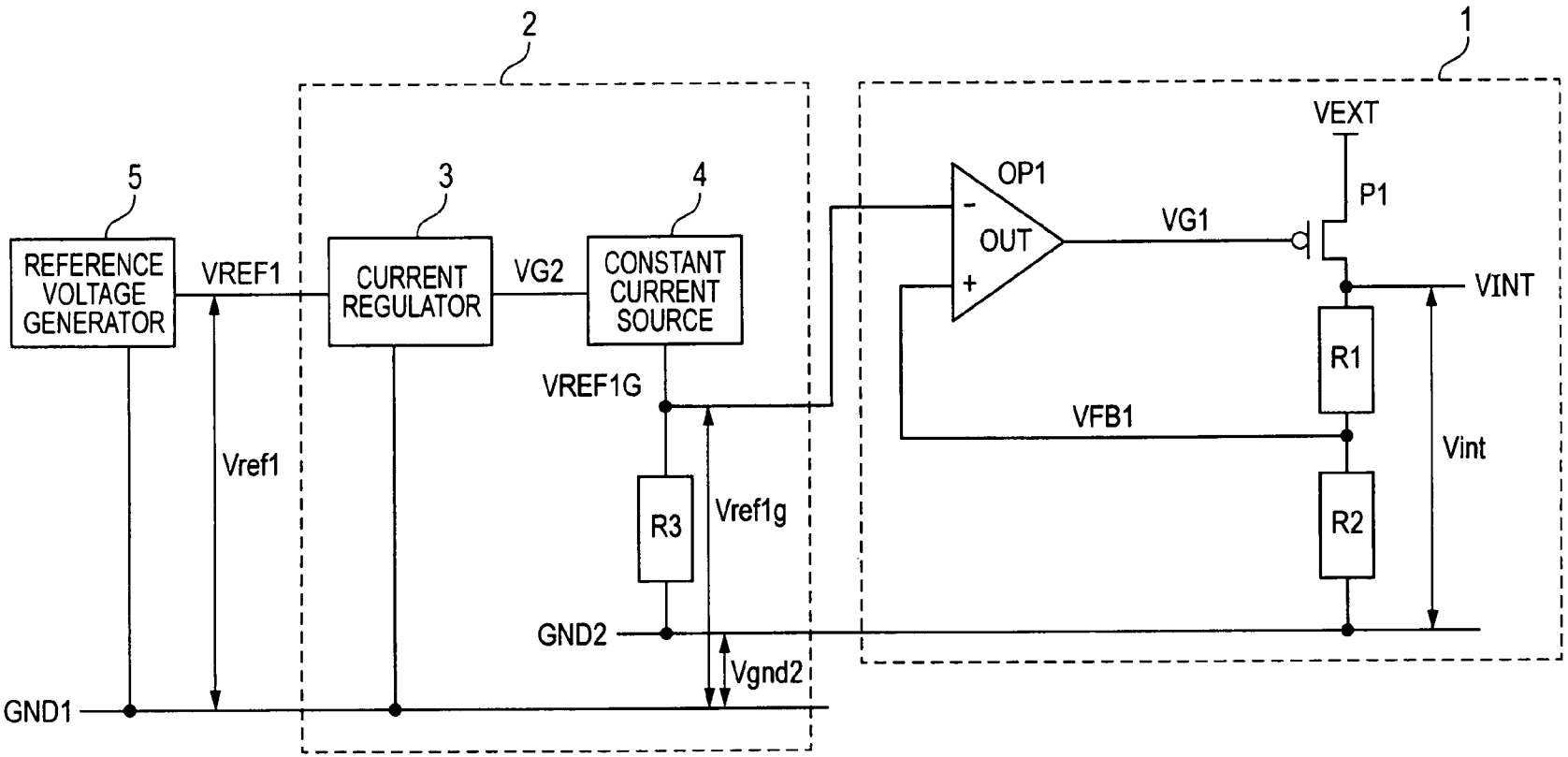
FIG. 1 is a circuit diagram of a semiconductor device pertaining to an exemplary embodiment of the present invention.

FIG. 1 is a circuit diagram of a semiconductor device pertaining to an exemplary embodiment of the present invention. In FIG. 1, the same reference numerals and symbols as in FIG. 3 denote the same components and their description is omitted. The semiconductor device comprises an internal power supply generator 1, a VREF1 regulator 2, and a reference voltage generator 5.

The VREF1 regulator 2 comprises a current regulator 3, a constant current source 4, and resistor element R3. The VREF1 regulator 2 modifies a potential Vref1 input to it to a potential Vref1*g* and outputs this potential Vref1*g* to the internal power supply generator 1.

The current regulator 3 receives an input of the reference potential Vref1 from the reference voltage generator 5 at a node VREF1 and outputs a current value regulating voltage for the constant current source 4 to a node VG2. The constant current source 4 provides a constant current based on the current value regulating voltage on the node VG2 so that the constant current flows via the resistor element R3 to GND2. Here, a node VREF1G which is a coupling point between the constant current source 4 and the resistor element R3 is coupled to an input terminal of the internal power supply generator 1.

The current regulator 3 adjusts the voltage on the node VG2 and drives the constant current source 4, so that the constant current source 4 provides constant current I2 which is expressed by Equation (2) below:

$$I2=Vref1/r4 \tag{2}$$

where r4 is an equivalent resistance value corresponding to a conversion coefficient.

Here, a value of resistance of the resistor element R3 is denoted by r3. Because the current I2 flowing in the constant current source 4 flows through the resistor element R3, given that a potential difference between GND1 and GND2 is denoted by Vgnd2, a potential Vref1*g* on the node VREF1G relative to GND1 is expressed by Equation (3):

$$Vref1g-Vgnd2=r3*I2 \tag{3}$$

By substituting Equation (2) into Equation (3), the following Equation (4) is obtained.

$$Vref1g-Vgnd2=r3/r4*Vref1 \tag{4}$$

At the node VREF1G, a potential "ref1*g*−Vgnd2" is input to the internal power supply generator 1. Hence, potential Vint relative to GND2 is expressed as in Equation (5) below, where the term of Vgnd2 is deleted by substituting Equation (4) into Equation (1).

$$Vint=Vref1*r3/r4*(r1/r2+1) \tag{5}$$

According to Equation (5), Vint remains at a constant potential independently of Vgnd2. That is, Vint which is the output voltage of the internal power supply generator 1 remains at a constant potential without being affected by a potential difference between GND1 and GND2, even if this potential difference occurs.

Figure 2:
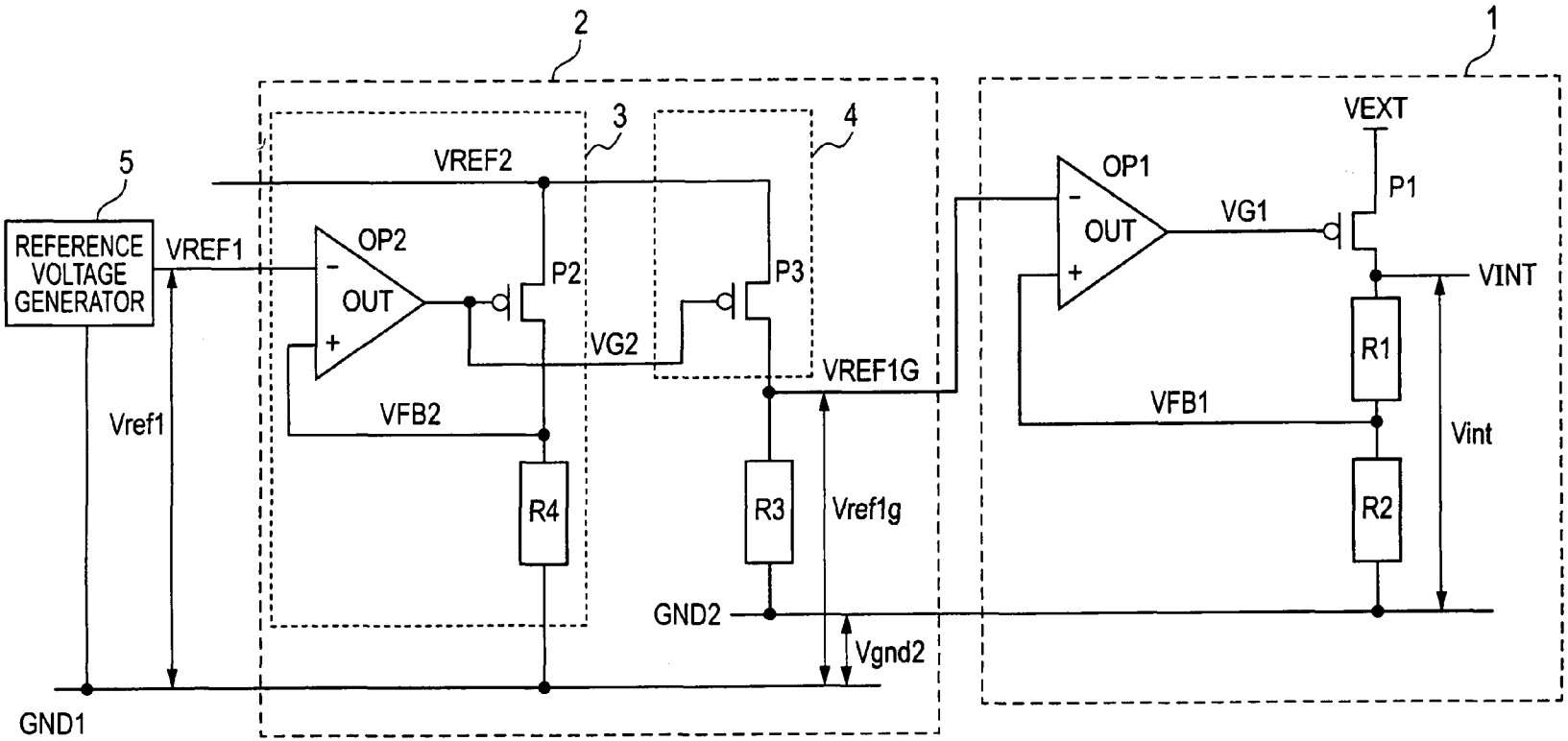
FIG. 2 is a circuit diagram illustrating details of the semiconductor device pertaining to the exemplary embodiment of the present invention.

Then, a concrete circuit configuration of the VREF1 regulator 2 is described. FIG. 2 is a circuit diagram illustrating in detail the semiconductor device pertaining to the exemplary embodiment of the present invention. In FIG. 2, the same reference numerals and symbols as in FIG. 1 denote the same components and their description is omitted. The current regulator 3 comprises an operational amplifier circuit OP2, a PMOS transistor P2, and a resistor element R4. The constant current source 4 comprises a PMOS transistor P3.

Of the operational amplifier circuit OP2, a noninverting input (+) terminal is coupled to a node VFB2, an inverting input (−) terminal is coupled to a node VREF1, and an output terminal is coupled to the node VG2. Thereby, the operational amplifier OP2 controls the potentials on the gates of the MOS transistors P2, P3. Of the PMOS transistor P2, a source is coupled to a node VREF2, a drain is coupled to a node VFB2, and a gate is coupled to the node VG2. The resistor element R4 is coupled between the node VFB2 and GND1.

Of the PMOS transistor P3, a source is coupled to the node VREF2, a drain is coupled to the node VREF1G, and a gate is coupled to the node VG2. The resistor element R3 is coupled between the node VREF1G and GND2. A current flowing in the PMOS transistor P3 flows through a VREF1G-to-GND2 path, thereby determining the potential Vref1g on the node VREF1G.

The node VREF2 is coupled to a node VEXT without IR-drop (which can be provided using a separate power supply or the like). Alternatively, the potential on the node VREF2 may be a second reference voltage generated from the reference voltage generator 5. However, it is required that the potential on the node VREF2 is a potential allowing the PMOS transistors P2, P3 to operate in a saturation region.

In the current regulator 3 configured as described above, the node VG which is the output of the operational amplifier OP2 stabilizes at a potential, as the potentials on the node VREF1 and the node VFB2 coupled to the noninverting input terminal and the inverting input terminal of the operational amplifier circuit OP2 are equal.

Current I1 flowing through the resistor element R4 is equal to a current flowing in the PMOS transistor P2. Given that a value of resistance of the resistor element R4 is denoted by r4, current I1 is expressed as in Equation (6) below:

$$I1=Vref1/r4 \tag{6}$$

Here, it is assumed that the PMOS transistors P2, P3 are configured to have the same size, that is, the same W/L. Because the same W/L of the PMOS transistors P2, P3 means that the gate-to-source potentials of these transistors are also equal, the current I2 flowing in the PMOS transistor P3 operating in the saturation region is as follows:

$$I2=I1 \tag{7}$$

Equations (6) and (7) indicate that r4 denoted in Equation (2) is realized by the resistor element R4.

Here, it is assumed that the value of resistance r3 of the resistor element R3 is equal to the value of resistance r2 of the resistor element R2. It is also assumed that the value of resistance r4 of the resistor element R4 is equal to the value of resistance r1 of the resistor element R1. In this case, Equation (5) is simplified as in Equation (8).

$$Vint=Vref1*(r2/r1)*(r1/r2+1)=Vref1*(r2/r1+1) \tag{8}$$

Although the foregoing description refers to a GND regulation method for providing an internal lower voltage power supply, the present invention is not so limited, but can be applied to other fields. For example, the invention can be applied to a circuit for monitoring for elevated GND by comparing Vint generated relative to GND1 and Vint generated relative to GND2. If GND2 is replaced by another analog potential, it is possible to implement a potential difference shift depending on the analog potential and the invention thus can be applied as a level shifter on an analog potential basis.

The disclosures of the previously mentioned patent documents and the like are incorporated herein by reference. Embodiments and exemplary embodiments of the present invention may be changed or adjusted without departing from the scope of the whole of the disclosure of the present invention (including the claims) and based on its basic technical concept. Various elements disclosed herein may be combined or selected in different ways without departing from the scope of the claims of the present invention. That is, as a matter of course, the prevent invention covers variants and modifications which could be made by those skilled in the art in accordance with the whole of the disclosure including the claims and its technical concept.

What is claimed is:

1. A semiconductor device, comprising:

a reference voltage regulator to which a reference voltage relative to a first potential is input; and an output circuit which generates an output voltage that is proportional to a voltage on its input terminal relative to a second potential, wherein the reference voltage regulator includes:

a constant current source which generates a constant current having a current value that is proportional to the reference voltage; and a first resistor element which is supplied with the constant current, one end of which is coupled to the input terminal of the output circuit and the other end of which is coupled to the second potential, wherein the reference voltage regulator further includes a current regulator which generates an internal current that is proportional to the reference voltage and drives the constant current source to generate the constant current that is proportional to the internal current, wherein the current regulator includes:

an operational amplifier with an inverting input terminal to which the reference voltage is applied;

a first MOS transistor having a source being coupled to a predefined power supply, a gate being coupled to an output of the operational amplifier, and a drain being coupled to a noninverting input terminal of the operational amplifier; and a second resistor element, one end of which is coupled to the drain of the first MOS transistor and the other end of which is coupled to the first potential, wherein the constant current source includes:

a second MOS transistor of the same conductivity type as the first MOS transistor, the second MOS transistor having a source being coupled to the predefined power supply, a gate being coupled to the output of the operational amplifier, and a drain through which the constant current is supplied to the first resistor element.

2. The semiconductor device according to 1, wherein the first and second potentials are respective potentials of two points having a potential difference therebetween in ground wiring.

* * * * *